United States Patent [19]

Nonaka et al.

[11] Patent Number: 4,563,611

[45] Date of Patent: Jan. 7, 1986

[54] IMAGE PICK-UP TUBE TARGET

[75] Inventors: Yasuhiko Nonaka; Eisuke Inoue, both of Mobara; Keiichi Shidara, Tama; Kenkichi Tanioka, Tokyo, all of Japan

[73] Assignee: Hitachi, Ltd., Tokyo, Japan

[21] Appl. No.: 548,022

[22] Filed: Nov. 2, 1983

Related U.S. Application Data

[63] Continuation-in-part of Ser. No. 319,795, Nov. 9, 1981, abandoned.

[30] Foreign Application Priority Data

Nov. 10, 1980 [JP] Japan ..... 55-157084

[51] Int. Cl.[4] ..... H01J 31/26

[52] U.S. Cl. ..... 313/366; 313/386

[58] Field of Search ..... 313/366, 386, 384

[56] References Cited

U.S. PATENT DOCUMENTS 4,330,733 5/1982 Shidara et al. ..... 313/386

*Primary Examiner*—Palmer C. DeMeo
*Assistant Examiner*—Sandra L. O'Shea
*Attorney, Agent, or Firm*—Charles E. Pfund

[57] ABSTRACT

A photoconductive image pick-up tube target comprises a transparent substrate, an N-type conductive film formed on the transparent substrate, and a P-type photoconductive film in rectifying contact with the N-type conductive film and containing Se, As and Te as sensitizer. The P-type photoconductive film includes a first layer contiguous to the N-type conductive film and containing 94±1% by weight of Se and 6±0.5% by weight of As, a second layer formed on the first layer and containing 64±4% by weight of Se, 3±0.5% by weight of As, and 33±2% by weight of Te, a third layer formed on the second layer and containing Se and As, and a fluoride doped region extending over the first layer and a front half layer of the second layer and having a fluoride concentration of 0.1 to 3.0% by weight. The third layer has an As concentration which has a peak of 28±1% by weight at a site contiguous to a rear half layer of the second layer and reduces gradually.

4 Claims, 3 Drawing Figures

IMAGE PICK-UP TUBE TARGET

This application is a continuation-in-part of application Ser. No. 319,795, filed Nov. 9, 1981 now abandoned.

BACKGROUND OF THE INVENTION

This invention relates to image pick-up tube targets and, more particularly, to an image pick-up tube target capable of effectively suppressing high-light sticking of the photoconductive film with respect to high brightness objects.

An image pick-up tube using the photoconductive film mainly containing Se, As and Te as target, as disclosed in U.S. Pat. No. 4,007,395, for example, has a drawback, so-called high-light sticking, in which a long trail follows a moving high brightness object being picked up and when the object is stationary, the trail persists for a long time. In order to overcome the above drawbacks, a proposal has been made by the inventors, by which LiF is doped in the Se-As-Te film to obtain very satisfactory effects.

High-light sticking can be resolved into an afterimage component and a sticking component. An afterimage component is a result of a phenomenon which occurs when the background of a high-light is dark and as the high-light is moved, it is observed as a tailing and is measured in terms of time till the time the tailing disappears. A sticking component then is due to a phenomenon caused when a high-light is imaged when the background is light. It is a phenomenon similar to printing as the term is used in the field of photography. Compared with a high-light afterimage, a high-light sticking is a phenomenon of long time constant and is expressed in terms of percentage in relation to a reference signal level.

However, if fluoride is doped in a Se-As-Te film in such an image pick-up tube target, the rising of current in the voltage-current characteristic of the photoconductive film is deteriorated and consequently, sufficient image signal current cannot be taken out, so that the image pick-up tube cannot be operated with practically satisfactory performances.

SUMMARY OF THE INVENTION

Accordingly, the invention has an object of providing an image pick-up tube target capable of improving the high-light sticking characteristic and preventing degradation of rise of current by stipulating the concentration of fluoride doped in the photoconductive film and the region of doping.

To attain this object, according to the invention, fluoride is continuously doped at a concentration ranging from 0.1 to 3.0% by weight uniformly over the plane of the photoconductive film and to a depth which is 10 to 50% of the thickness of a tellurium containing layer.

DESCRIPTION OF PREFERRED EMBODIMENT

Figure 1:
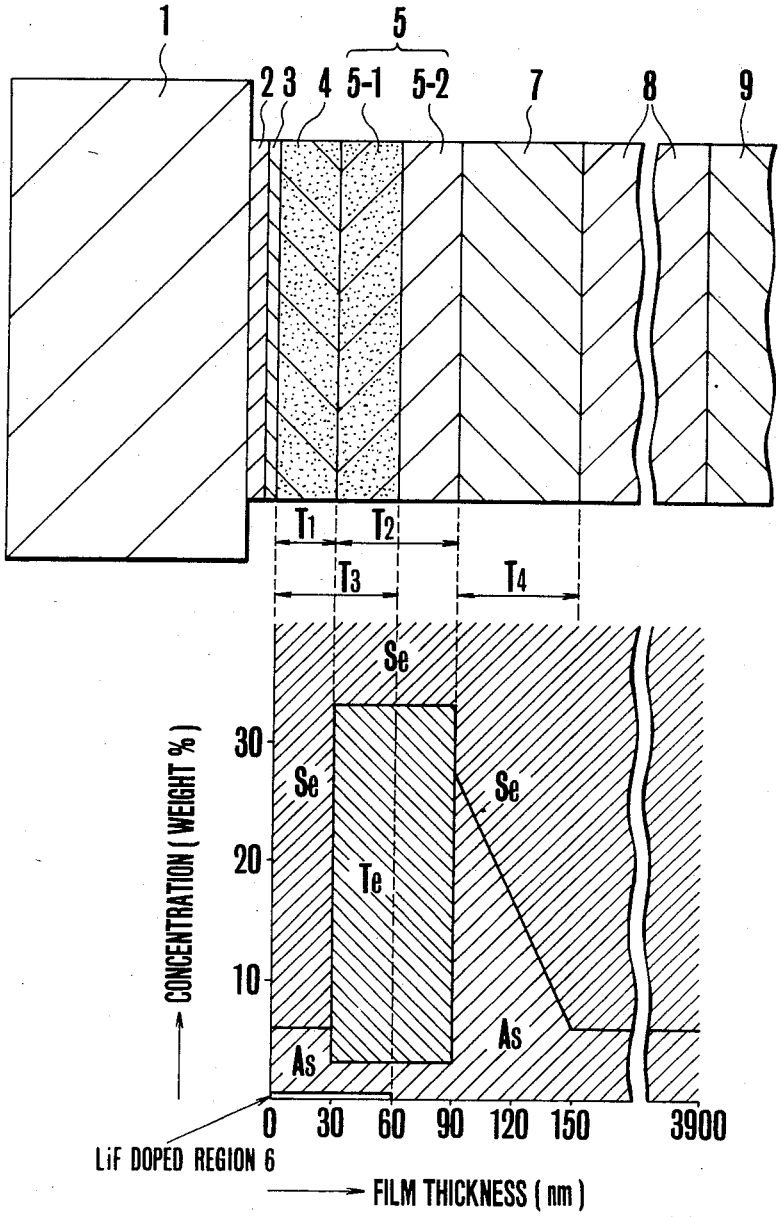
FIG. 1 illustrates a fragmentary sectional view, along with a concentration distribution diagram, showing one embodiment of the image pick-up tube target according to the invention.

Referring now to FIG. 1, a transparent electrode 2 mainly composed of, for instance, $SnO_2$ is formed on a glass substrate 1 which is made of a transparent material. A very thin transparent N-type conductive film 3 composed of, for example, CeO is formed on the upper surface of the transparent electrode 2. A first layer 4 of a P-type photoconductive film consisting of a P-type amorphous semiconductor of a Se-As system containing 94±1% by weight of Se and 6±0.5% by weight of As is formed to a thickness of $T_1=30\pm3$ nm on the N-type transparent film 3, and a second layer 5 of the P-type photoconductive film consisting of a P-type amorphous semiconductor of a Se-As-Te system containing 64±4% by weight of Se, 3±0.5% by weight of As and 33±2% by weight of Te is formed to a thickness $T_2=60\pm5$ nm over the of upper surface of the first P-type photoconductive layer 4. Between the first P-type photoconductive layer 4 and a front half layer 5-1 (30±3 nm) of the second P-type photoconductive layer 5, a LiF doped region 6 containing LiF doped at a concentration of 0.4±0.1% by weight is formed continuously and uniformly over the plane of the film to a thickness of $T_3=60\pm6$ nm. This film reaches a depth of about 60±6 nm from the light incidence surface of the first P-type photoconductive layer 4. A third layer 7 of the P-type photoconductive film of a Se-As system P-type amorphous semiconductor containing Se and As is formed to a thickness of $T_4=60\pm10$ nm on a rear half layer 5-2 of the second P-type photoconductive layer 5, with a concentration distribution in which a concentration of 72±1% by weight of Se and a peak concentration of 28±1% by weight of As lying adjacent to the rear half layer 5-2 change gradually to 97±1% by weight of Se and 3±1% by weight of As, respectively. Between thicknesses 150 nm and 3900 nm, a fourth layer 8 is formed on the third layer, containing 97±1% by weight of Se and 3±1% by weight of As to complete the P-type photoconductive film. Further, a conductive film 9 of $Sb_2S_3$ is vapor deposited to a thickness of about 100 nm on the P-type photoconductive film, particularly on the fourth layer 8 and serves to assist the landing of scanning beams.

In the image pick-up tube target having the above construction, LiF is doped at a concentration of 0.4±0.1% by weight to a depth of about 60 nm ranging from the light incidence surface of the first P-type photoconductive films 4 to the rear surface of the front half layer 50-1 of the second layer 5, and the peak concentration of As in the third P-type photoconductive layer 7 is stipulated as 28±1% by weight.

Figure 2:
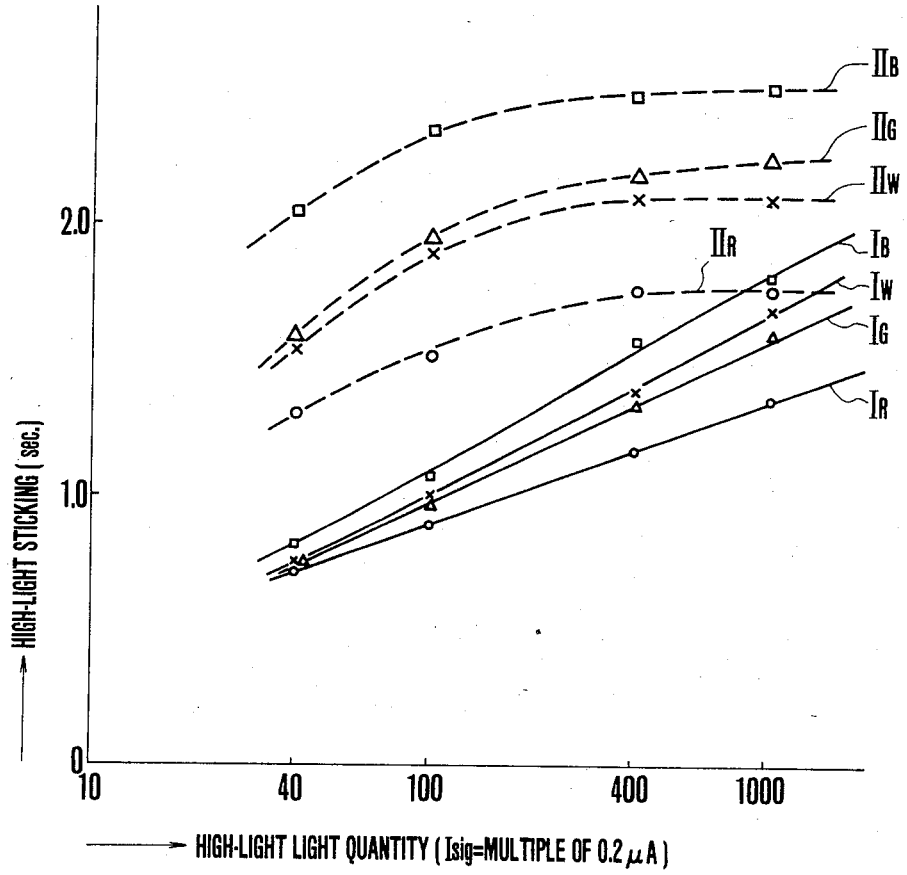
FIG. 2 illustrates high-light sticking characteristics of the image pick-up tube target according to the invention.

In this way, it is possible to greatly improve the high-light sticking characteristic and rising of current in the voltage-current characteristic of the photoconductive film, thus ensuring delivery of sufficient image signal current. As a result, high-light sticking characteristics as shown in FIG. 2 can be obtained. The blue, white, green and red light high-light sticking characteristics $I_B$, $I_W$, $I_G$ and $I_R$ as shown by solid curves according to the invention are about one half the corresponding high-light sticking characteristics $II_B$, $II_W$, $II_G$ and $II_R$ as shown by dashed curves. For a long period operation, the high-light sticking can be reduced to about 1/10 compared to the case of the non-doped film. The aforementioned effect can be obtained so long as the peak concentration of As contained in the third P-type photoconductive layer 7 is within a range of 23 to 33% by weight. Outside this range, the high-light sticking is extremely increased. Thus, the most satisfactory effect is obtained with an optimum range of the As peak concentration of 28±1% by weight.

While in the above embodiment LiF is doped at a concentration of 0.4±0.1% by weight and the thickness of the LiF doped region is 60±6 nm from the light incidence surface, this is by no means limitative.

Figure 3:
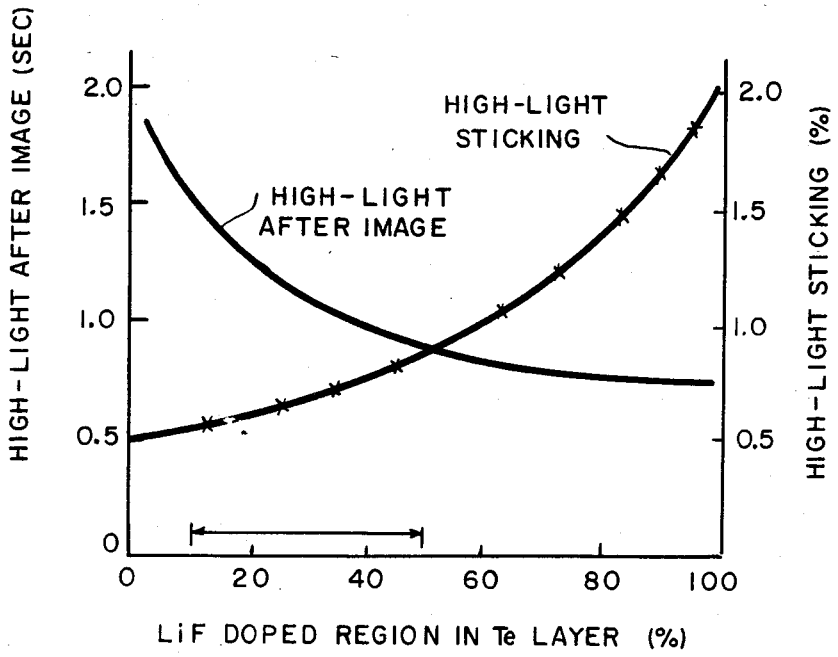
FIG. 3 illustrates high-light sticking characteristics and high-light afterimage effects in an image pick-up tube target as the depth of the fluoride doping is varied.

Referring now to FIG. 3, the high-light sticking characteristics and high-light afterimage effects are illustrated as a function of the depth of the LiF. If LiF is doped to a depth of 100% of the Te-containing layer (which would be to a depth of 90 nm. in FIG. 1), high-light sticking is insufficiently suppressed. In this instance, the high-light afterimage (tailing phenomenon) is suppressed suitably when the background of the high-light is completely dark, but high-light sticking suppression is ineffective when the background is light. The high-light sticking phenomenon became aggravated and for practical purposes the high-light sticking suppression was lost. As shown in FIG. 3, for practical purposes the best results are obtained when LiF is doped to a depth of 10 to 50% of the depth of a Te-containing layer (36 to 60 nm. in FIG. 1). The preferred LiF concentration is in a range between 0.3 and 0.8% by weight.

Further, while the above embodiment has been described by using the image pick-up tube with the Se-As-Te photoconductive film, this is by no means limitative, and the same effects as mentioned above can of course be obtained with a photoconductive film of other structures.

Further, while in the above embodiment LiF has been used as fluoride doped in the photoconductive film, this is by no means limitative, and similar effects can of course be obtained by using other fluoride such as $CaF_2$. In this case, the concentration of the fluoride may be suitably selected in consideration of dope concentration variation in a range between 0.1 and 3% by weight.

As has been described in the foregoing, with the image pick-up target according to the invention it is possible to extremely reduce the residual image of the film with respect to a high brightness object and high-light sticking and prevent degradation of rise of current, thus permitting a picked-up image of high quality to be obtained.

What is claimed is:

1. In a photoconductive image pick-up tube target comprising an N-type conductive film formed on a transparent substrate, and a P-type photoconductive film in rectifying contact with said N-type conductive film and having a plurality of layers, each containing Se and As and one containing Te as sensitizers, said P-type photoconductive film being doped with fluoride as an impurity, the improvement wherein the doping of said p-type photoconductive film with fluoride is effected from the light incident end surface of said film in the direction of the thickness of said film continuously and at a substantially uniform concentration lying within a range of from 0.1 to 3.0% by weight to a depth which is 10 to 50% of the thickness of the Te-containing layer.

2. An image pick-up tube target according to claim 1 wherein said fluoride is LiF.

3. An image pick-up according to claim 1 wherein said fluoride is $CaF_2$.

4. A photoconductive image pick-up tube target comprising:

a transparent substrate;

an N-type conductive film formed on the transparent substrate; and a P-type photoconductive film in rectifying contact with said N-type conductive film and containing Se, As and Te as sensitizer, said P-type photoconductive film including:

a first layer contiguous to the N-type conductive film and containing 94±1% by weight of Se and 6±0.5% by weight of As;

a second layer formed on the first layer and containing 64±4% by weight of Se, 3±0.5% by weight of As, and 33±2% by weight of Te;

a third layer formed on the second layer and containing Se and As; and a fluoride doped region extending over the first layer and a front half layer of the second layer and having a fluoride concentration of 0.1 to 3.0% by weight, said third layer having an As concentration which has a peak of 28±1% by weight at a site contiguous to a rear half layer of the second layer and reduces gradually.

* * * * *